US007341234B2

(12) United States Patent
Kowalski

(10) Patent No.: US 7,341,234 B2
(45) Date of Patent: Mar. 11, 2008

(54) TREE STAND, IN PARTICULAR CHRISTMAS TREE STAND WITH IMPROVED RELEASE FUNCTION

(75) Inventor: Artur Kowalski, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 133 days.

(21) Appl. No.: 11/304,228

(22) Filed: Dec. 14, 2005

(65) Prior Publication Data

US 2006/0226332 A1 Oct. 12, 2006

(30) Foreign Application Priority Data

Mar. 24, 2005 (DE) ..... 10 2005 013 901

(51) Int. Cl.
*F16M 13/00* (2006.01)

(52) U.S. Cl. ..... 248/523; 248/525; 47/40.5

(58) Field of Classification Search ..... 248/523, 248/519, 524, 525; 47/40.5
See application file for complete search history.

(56) References Cited

U.S. PATENT DOCUMENTS

| | | | | |
|---|---|---|---|---|
| 5,114,113 | A * | 5/1992 | Krinner | 248/525 |
| 5,464,186 | A * | 11/1995 | Robert | 248/524 |
| 6,012,698 | A * | 1/2000 | Hardt et al. | 248/523 |
| 6,854,700 | B2 * | 2/2005 | Schmitz | 248/523 |
| 6,877,708 | B1 * | 4/2005 | Thurner | 248/519 |
| 6,988,702 | B2 * | 1/2006 | Schulz | 248/525 |
| 2003/0193046 | A1 | 10/2003 | Chen | |
| 2007/0012851 | A1 * | 1/2007 | Krinner | 248/524 |

FOREIGN PATENT DOCUMENTS

| | | | |
|---|---|---|---|
| DE | 102 20 879 | | 8/2003 |
| DE | 10233766 | | 11/2003 |
| DE | 20 2004 020 005.8 | | 5/2005 |
| DE | 20 2004 020 006 | | 5/2005 |
| DE | 10362070 | A1 * | 9/2005 |
| DE | 102005003266 | B3 * | 2/2006 |
| DE | 10 2004 062 826 | | 7/2006 |

* cited by examiner

*Primary Examiner*—Anita M. King
(74) *Attorney, Agent, or Firm*—Jordan and Hamburg LLP

(57) ABSTRACT

The tensioning device of a tree stand has a tension lever, a ratchet wheel and a tensioning body coaxial therewith, and a lever catch that is movably guided on the tension lever like a ratchet or one-way coupling and that is detachably mechanically linked to the ratchet wheel and that when the tension lever is actuated to create tension engages the teeth of the ratchet wheel such that a part connected to elements for retaining the tree is wound on the tensioning body, thus securely clamping the tree. The tensioning device furthermore has a first catch for engaging the teeth of the ratchet wheel and blocks the latter's rotation in the sense of unwinding of the tensioning body. For each release actuation of the tension lever, the first catch disengages from the teeth of the ratchet wheel, whereby thereupon a second catch blocks the release when the second catch strikes the blocking flank of the tooth of the ratchet wheel in the release direction.

18 Claims, 8 Drawing Sheets

TREE STAND, IN PARTICULAR CHRISTMAS TREE STAND WITH IMPROVED RELEASE FUNCTION

BACKGROUND OF THE INVENTION

The invention relates to a tree stand, in particular a Christmas tree stand.

The basic structure of tree stands of this type is known for instance from DE 102 20 879 A1. In this case, a flexible connecting part that can be loaded with tension is provided; it passes through all pivotably arranged retaining elements transversely movable and both of its ends are attached to a cable drum. When the cable drum is rotated, the cable is wound and tautened thereupon, which draws the pivotable retaining elements inward against the tree trunk so that they finally clamp the latter in that they are distributed around the circumference of the tree trunk and hold the tree in the stand with the retaining force. In this known stand, the various parts for winding and tautening the cable are combined in an installable tensioning device with its own housing. The cable drum, among other things, is then borne in the housing. The housing also receives a tension lever that is mechanically linked to a ratchet wheel like a type of ratchet or one-way coupling. In this known tree stand, the housing of the tensioning device takes the form of a pocket with a U-shaped cross-section. The cable drum, upon which the ratchet wheel is situated rotation-fast, is borne in the two side parts of the housing. The ratchet wheel, which is provided with teeth, cooperates with two movable catches. The one is a housing catch that is embodied as a locationally fixed, supported and movable blocking member like a type of pawl and that engages the teeth of the ratchet wheel under spring force. The other catch is a lever catch that can be displaced longitudinally in the tension lever and that is also prestressed against the teeth of the ratchet wheel. The teeth of the ratchet wheel are embodied in the usual manner with blocking flanks and inclined flanks. They act such that when one or both catches are engaged, the ratchet wheel can only rotate in such a direction that the cable is wound and tautened. For releasing the tensioning device, in every case the locationally fixed supported movable blocking member, i.e. the housing catch, must be removed from the area of the teeth of the ratchet wheel using an external intervention. The lever catch must also be withdrawn.

While the locationally fixed, supported movable blocking member is intended to prevent the cable drum from unwinding, the lever catch produces a mechanical link like a one-way coupling or ratchet between the tension lever, which can be rotated independent of the cable drum, and the cable drum. The function or working manner when releasing the tensioning device is described in detail in German application 10 2005 003 266.4, the disclosure of which is hereby incorporated herein by reference.

This embodiment of the known tensioning device has the advantage of simple and pleasant operability. However, there is the risk that the tension lever can be inadvertently or deliberately moved from the first position, the retaining position, to the second position, the release position. This could occur solely due to upward movement by the tension lever and could mean inadvertent release from the retaining position, whereby there would then be the risk that the tree would fall out of the stand or fall over with the stand. Therefore, present on the tension lever of the tree stand is a special transverse lock that in its active position prevents an upward movement by the lever catch. In this locked condition, the tension lever can only be pivoted in the area of a first guide track, but can no longer move to the against the teeth of the ratchet wheel. The teeth of the ratchet wheel are embodied in the usual manner with blocking flanks and inclined flanks. They act such that when one or both catches are engaged, the ratchet wheel can only rotate in such a direction that the cable is wound and tautened. For releasing the tensioning device, in every case the locationally fixed supported movable blocking member, i.e. the housing catch, must be removed from the area of the teeth of the ratchet wheel using an external intervention. The lever catch must also be withdrawn.

While the locationally fixed, supported movable blocking member is intended to prevent the cable drum from unwinding, the lever catch produces a mechanical link like a one-way coupling or ratchet between the tension lever, which can be rotated independent of the cable drum, and the cable drum. The function or working manner when releasing the tensioning device is described in detail in German application 10 2005 003 266.4, the disclosure which is hereby incorporated herein by reference.

This embodiment of the known tensioning device has the advantage of simple and pleasant operability. However, there is the risk that the tension lever can be inadvertently or deliberately moved from the first position, the retaining position, to the second position, the release position. This could occur solely due to upward movement by the tension lever and could mean inadvertent release from the retaining position, whereby there would then be the risk that the tree would fall out of the stand or fall over with the stand. Therefore, present on the tension lever of the tree stand is a special transverse lock that in its active position prevents an upward movement by the lever catch. In this locked condition, the tension lever can only be pivoted in the area of a first guide track, but can no longer move to the area of a second guide track. For this, first the additional transverse lock must be released. Inadvertent release of the clamping position is largely prevented with this embodiment. However, it is still possible for the transverse lock to be released deliberately and for the tree therefore to fall out of the stand. With respect to use as a Christmas tree stand, particular consideration must be given to the fact that children might actuate the transverse lock while playing and that an accident could occur due to the tree falling over. For this reason child safety locks for such Christmas tree stands were developed in the aforementioned German application 10 2005 003 266.4. These child safety mechanisms can largely prevent children from inadvertently releasing the tensioning device, but these tensioning devices are still burdened with the disadvantage that once the child safety measure has been introduced, by releasing the lever catch the retaining elements are immediately transitioned from their retaining position to the release position, which can certainly result in the tree falling over.

A tree stand of similar construction is known from German utility patent application 20 2004 020 005.8, in which the free ends of the retaining elements that are intended to be placed against the tree trunk are embodied as smooth, arched sliding surfaces. This embodiment permits the placement of the tree trunk in the stand to be corrected, i.e., the tree can still be aligned in the stand when the retaining elements are already placed against the tree trunk with notable retaining force. It has been found, that is, that the retaining elements of the known stand exert sufficiently strong clamping force on the tree trunk even when the free ends of the retaining elements are not provided as conventional pointed claws but rather are provided as arched, smooth sliding surfaces or are even provided with placement bodies that are embodied to be slidable against the trunk. However, these known stands have the disadvantage that a certain amount of experience is required to place the retaining elements against the tree trunk with enough retaining force that the tree is held up, on the one hand, but on the other hand can still be aligned in the stand. With this stand, it is entirely possible that without this experience first attempts to effect clamping will exert enough retaining force on the claws that alignment is not possible or is only possible with considerable effort, despite the sliding surfaces and the support body. In such a case, the tensioning device must be released again. Releasing leads to a situation in which the retaining elements spring back immediately out of their retaining position or "almost no longer alignment position" into the release position. In this case, as well, there is a risk that the tree will fall over. It is also disadvantageous that when the retaining elements are completely open, i.e., when retaining elements are in their release position, the complete tensioning process must as a rule start over from the beginning, along with the associated multiple up and down movements of the tension lever for the tensioning device.

The object of the invention is therefore to embody a tree stand, especially a Christmas tree stand, of the type cited in the foregoing such that when the locking device is released the retaining elements are not suddenly, i.e., not all at once, transitioned out of their retaining position into the release position.

SUMMARY OF THE INVENTION

In accordance with a first aspect of the invention, the tree stand, especially a Christmas tree stand, has two or more retaining elements that are arranged movable about an axis of symmetry of a foot part and that are movable, with at least one flexible connecting part that can be loaded with tension by actuating a tensioning device, between a release position in which a tree can be inserted between the retaining elements or can be removed therefrom, and a retaining position in which a tree is held, in a plane intersecting the axis of symmetry, whereby the retaining elements can also be pivotably movable. The tensioning device has a rotatable tension lever, a toothed ratchet wheel, a tensioning body, preferably in the form of a drum on which the connecting part can be wound, and a lever catch. The tensioning device functions like a type of ratchet or one-way coupling via the lever catch that is movably guided in its tension lever and that is detachably mechanically linked to the ratchet wheel. When the tension lever of the tensioning device is actuated, the lever catch preferably engages, under spring force or gravitational force, the teeth of the ratchet wheel such that the connecting part is wound on the tensioning body that is coaxial with the ratchet wheel, this clamping the tree securely. In accordance with the invention, every time the tension lever is actuated in the sense of releasing the tensioning device, specifically counter to the direction of movement of the tension lever during the tensioning actuation, the first catch disengages from the teeth of the ratchet wheel. This results in a release movement of the tensioning body, i.e., the connecting part is unwound from the tensioning body by a defined unwinding path. This defined unwinding path is shorter than the total unwinding path that the tensioning body travels when the retaining elements transition from their retaining position into their release position. Then a second catch in a gap between two teeth of the ratchet wheel blocks such that further release only occurs until the second catch strikes the tooth of the ratchet wheel that limits the gap, in the release direction, into which the second catch has been moved, this ending such a release increment. This means that after the first catch is released from the teeth of the ratchet wheel, the tension of the connecting part acts in the sense that the connecting part then endeavors to be unwound under its tension. Unwinding and thus opening of the retaining elements out of the retaining position into an intermediate position that is still relatively quite different from the release position by a defined unwinding path is only possible until the second catch engages the teeth of the ratchet wheel. This can preferably occur such that the first and the second catch alternately support or block and correspondingly release the ratchet wheel tooth by tooth. However, it is also possible that the incremental release of the unwinding process, i.e., the incremental transition of the retaining apparatus to intermediate positions between the retaining position and the release position occurs by unwinding by two or more teeth until the ratchet wheel and thus the tensioning body is again blocked. The first and the second catch, in connection with the teeth of the ratchet wheel, act as a blocking member. The second catch can thus be inserted into the teeth at the same time as or chronologically after the first catch disengages from the teeth.

An essential advantage of such an incremental release of the retaining elements during their transition from the retaining position to the release position is the clearly reduced risk of injury. Startling the operator, which can certainly occur when someone inadvertently releases the retaining elements of a known stand, whereupon the retaining elements suddenly move out of the retaining position into the release position, as is the case with known tree stands, this possibly causing the tree to tip over, is avoided.

Furthermore, there is an advantage in particular with those stands whose retaining elements or claws are provided with rounded sliding surfaces or with support elements that can slide against the trunk or with elastic elements. Such stands are described in applications DE 20 2004 020 005, DE 20 2004 020 006, and DE 10 2004 062 826. During tautening, an inexperienced user is certainly able to attain such retaining force that the desired effect no longer occurs, namely being able to align the tree before it is held with great retaining force so that it is unalignable. In such a case, when a known stand is in use, the operator must release the retaining elements completely by transitioning to the release position. The advantage of the inventive stand is now comprised in that this release occurs incrementally such that from the retaining position an alignment position can be attained where necessary in the first increment in which the tree can be aligned but is still held, specifically without the tree falling over. The operator now does not have to reinitiate a complete tautening process, but rather once alignment of the trunk has been performed can retauten using one or only a few actuations of the tension lever.

Another advantage is that when the tree is being removed from the stand, the retaining elements only have to be opened out of the retaining position in the direction of the release position until the tree can be removed. Thus, it is possible with a few tautening increments to have the retaining elements move into the trunk receiving part, which is necessary to guide the stand back into its packaging. Thus there is less work for the user.

In accordance with a second aspect of the invention, the tensioning device of the tree stand, especially a Christmas tree stand, that in its basic function and in its basic structure corresponds to that described with regard to the first aspect, has a first toothed ratchet wheel and a second toothed ratchet wheel. The basic structure corresponds to that described with regard to the first aspect, the two ratchet wheels are arranged relative to one another in this tree stand in accordance with the second aspect such that the second ratchet wheel preferably is arranged coaxial with the first ratchet wheel and such that it has the same phase and rotates with it. However, it is also possible that the two ratchet wheels are movable relative to one another by a certain angle, whereby this relative movement can be dampened via springs. In each release actuation of the tension lever, specifically counter to its movement during tensioning actuation, the first catch disengages from the teeth of the first ratchet wheel, a release movement of the tensioning body occurring by a defined unwinding path, whereby the unwinding path is shorter than the maximum unwinding path that results when the retaining elements transition completely into their release position. Then a second catch blocks in the teeth of the second ratchet wheel in that it moves into a gap between adjacent teeth of the second ratchet wheel and strikes a blocking flank of a tooth. This prevents further release at the moment at which the second catch strikes the back tooth in the unwinding direction of the gap into which the second catch has moved. Thus, in the case in which the second ratchet wheel is connected to the first, the second ratchet wheel and thus the tensioning body is blocked in its unwinding movement so that the unwinding increment that corresponds to the unwinding path is terminated by the second catch striking the blocking flank of the back tooth of the tooth gap of the ratchet wheel.

Since each catch cooperates with its ratchet wheel, greater flexibility is possible in determining the magnitude of the tensioning increment and the magnitude of the unwinding increments, that is, the release increments.

Preferably the first ratchet wheel and the second ratchet wheel have identical teeth modules. This means that both the size and the number of teeth for each ratchet wheel are the same. In such a case, the fineness of the tensioning movement is the same as that of the release movement. However, it is also possible that the first ratchet wheel and the second ratchet wheel have teeth modules that are different from one another. Thus for instance the first ratchet wheel can have finer teeth so that more precise closing is attained during the tensioning movement. At the same time, the second ratchet wheel, with which the second catch cooperates, can have coarser teeth. In this case it is possible that a coarser opening path is attained during release. This means that the unwinding path that is defined for instance by tooth spacing of the second ratchet wheel is greater than the unwinding path corresponding to one tooth spacing of the first ratchet wheel.

Preferably the first catch, given the action of a spring or the action of gravitational force, engages in the teeth of the first ratchet wheel in order to block the latter. However, it is also possible that a correspondingly provided movably designed cam ensures that the first catch engages the teeth of the first ratchet wheel to block the latter. In accordance with a further embodiment of the invention there is preferably blocking or releasing of the first or second catch alternating tooth by tooth due to the engagement of the respective catch in its respective associated ratchet wheel. This makes particular sense when the tooth modules of both ratchet wheels are embodied identically.

Preferably the tension lever is provided with a control curve by means of which, when the tension lever is actuated, the first catch is caused to disengage from the teeth of the associated ratchet wheel, whereby the control curve is preferably embodied integrally with the tension lever and is arranged on the tension lever such that when it approaches an upright position the first catch is pressed out of the teeth of the associated ratchet wheel. The advantage is comprised in that in such an embodiment, when the tension lever is actuated in a certain position, the first catch is "automatically" pressed out of the teeth for the purpose of initiating the unwinding movement. The unwinding movement is then interrupted again, i.e. the retaining elements are opened incrementally, when the second catch moves into the teeth of the associated ratchet wheel and prevents further unwinding.

Preferably the tensioning device has a housing in which the first catch, which is preferably supported locationally fixed, is movable. However, it is also possible that the first catch is seated on a separate support, preferably a shaft or pin that can be moved such that the first catch is movable between an engaged position into the teeth and a disengaged position out of the teeth of the associated ratchet wheel. The first catch, given the action of a spring that is arranged between the first and second catch, engages in the teeth of the associated ratchet wheel. One advantage of such a tensioning device arranged in a housing is comprised in that the tensioning device can be embodied as a complete module and can be easily inserted as a block into a correspondingly provided guide or guide block into the tree stand, whereby the tensioning device in the tautened condition is drawn against the block and therefore does not have to be separately immobilized on the foot plate of the tree stand.

In accordance with another further development of the invention, the retaining elements of the tree stand have at their free ends, which are intended to be placed against the trunk of the tree, arched smooth sliding surfaces or support surfaces embodied to be slidable on the trunk and which can also have elastic areas. This has the advantage that for instance when the tree has been clamped such that it is no longer possible to align it, in the inventive tree stand, in which the tensioning device is released incrementally, release occurs by one or a certain number of increments. This means that the retaining elements are only removed from the trunk far enough that they still hold the trunk, i.e. the tree cannot fall over, but the tree can still be aligned in the stand. After alignment, the user can even let go of the tree, step back from the tree, and confirm from a distance the direction in which he should make adjustments. If the alignment process is then concluded in that by pressing the tree into the desired position the sliding elements or the support bodies of the retaining elements slide against the trunk, it is immediately possible to re-clamp the tree in the desired aligned position with only relatively slight actuation of the tensioning device, without having to initiate an entirely new tensioning process, as is the case with known Christmas tree stands. Due to the now partially released condition of the retaining elements, secure re-clamping after alignment is accomplished by actuating the tensioning device by only a slight path without leaving the aligned position.

In accordance with another further development of the tree stand, provided for the tensioning device is an additional key or switching mechanism by means of which the function of the second catch—to transition the retaining elements only incrementally out of the retaining position into the release position—is by-passed. This particularly makes sense when the tree is to be completely removed from the stand. That is, in such a case incremental release is not necessarily required unless the retaining elements are only to be opened wide enough that the tree can just be removed in order, for the purpose of packing, not to have to pivot the retaining elements back the entire path in the direction of the trunk receiving part. Preferably the key can be inserted into an aperture in the tension lever such that the second catch is disengaged against the action of the spring from the teeth of the associated ratchet wheel so that in this special case the incremental transition of the retaining elements out of their retaining position into their release position is prevented.

In accordance with one further development of the invention, at an area situated within the housing of the tensioning device the tension lever preferably has a control cam that, when the tension lever of the tensioning device is actuated, presses the second catch into a corresponding gap between adjacent teeth of the associated ratchet wheel.

Preferably the control cam is embodied integrally with the tension lever. For instance the back end of the tension lever can have an angled segment that, when there is an upward movement of the tension lever, comes into contact with the second catch and presses the second catch against the spring into the teeth, i.e. into the gap between two adjacent teeth, this interrupting the release of the ratchet wheel or wheels caused by the first catch and thus the unwinding of the connecting part and thus the opening of the retaining elements in a first increment.

In accordance with another preferred embodiment, the first and the second catches are joined to one another, preferably rigidly, like a type of rocker. This rocker can be pivoted about a common point of rotation and is arranged with respect to the ratchet wheel or wheels such that during rotation about this point of rotation, specifically depending on the direction of this rotation, in the condition released by the first catch the associated ratchet wheel is blocked by the second catch incrementally in its release in the condition released by the first catch. This blocking can preferably occur tooth by tooth, but it is also possible that for instance blocking of the release movement of the ratchet wheel or wheels occurs at intervals of every second or third tooth. In such an embodiment of a rigid connection of the first and second catches to one another, the two catches form a defined angle to one another and are arranged with respect to the ratchet wheel or wheels such that they cover an area with a defined number of teeth of the ratchet wheel or wheels and specifically such that when the first catch is in the disengaged position, the second catch moves between adjacent teeth into the gap present there and thus immediately thereafter blocks the initiation of the release movement on the blocking flank of the tooth.

In accordance with another aspect of the invention, the tree stand, especially a Christmas tree stand, in a known manner has two or more retaining elements arranged movable about an axis of symmetry of a foot part, each of which retaining elements is movable, preferably pivotably movable, between a release position and a retaining position in a plane, whereby the retaining elements are arranged such that their planes intersect in the axis of symmetry. The retaining elements are moved out of the release position into the retaining position by the actuation of a tensioning device with at least one flexible connecting part that can be loaded with tension. The tensioning device has a rotatable tension lever, a toothed ratchet wheel, preferably a ratchet wheel that has its teeth on the end facing, a tensioning body, and a lever catch. The lever catch is movably guided on the tension lever like a catch or one-way coupling and is detachably mechanically linked to the ratchet wheel. When the tension lever is actuated to create tension, this lever catch engages in the teeth of the ratchet wheel such that the connecting part is wound on the tensioning body that is arranged coaxial with the ratchet wheel and the tree is thereby securely clamped. Furthermore, the tensioning device has a catch that in its active position engages in the teeth of the ratchet wheel and blocks the latter from rotating in the unwinding direction. Inventively, during each release actuation of the tension lever that is counter to the direction of the movement during a tensioning actuation, the catch now disengages from the teeth of the ratchet wheel. This results in a release actuation of the tension body by a defined unwinding path that is shorter than the maximum unwinding path. Then, in that it moves back into a gap between adjacent teeth of the ratchet wheel, the catch blocks further release after the catch strikes the back tooth (in the unwinding direction) of the gap of the ratchet wheel, i.e. at its blocking flank.

One advantage of a tree stand in accordance with this aspect of the invention is comprised in that only a single catch is required for general blocking of the unwinding movement and for incremental initiation of the unwinding movement. This results in a particularly simple structure. For reliable functioning, it is merely necessary that, after initiating the unwinding movement, the catch is moved rapidly enough back into the teeth of the ratchet wheel for blocking the complete unwinding movement.

The defined unwinding path can vary from unwinding increment to unwinding increment.

BRIEF DESCRIPTION OF THE DRAWINGS

Additional advantages, features, and application options of the invention are now explained in greater detail using exemplary embodiments, with reference to the drawings.

DETAILED DESCRIPTION OF THE INVENTION

Figure 1:
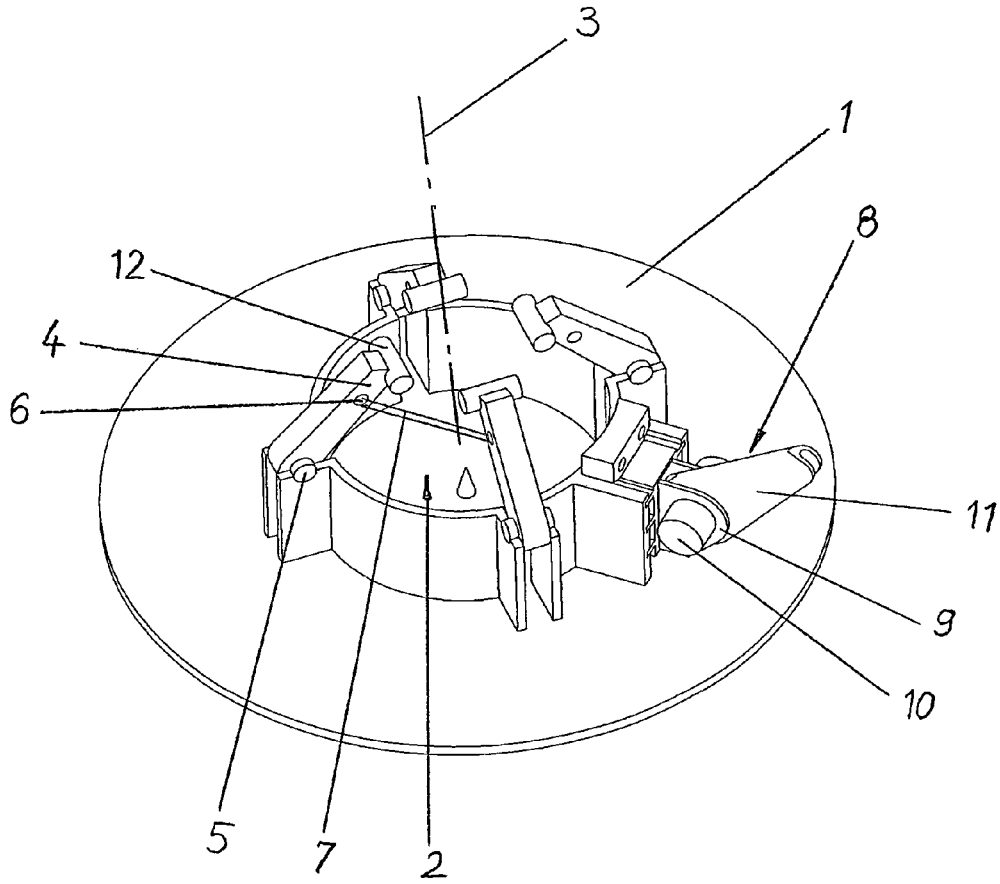
FIG. 1 is a principal design for a tree stand in the configuration with support bodies on the area of the retaining elements that are positioned against the tree in accordance with a first exemplary embodiment.

FIG. 1 illustrates a physically oblique view from above of an exemplary embodiment of the inventive stand. The cover has been omitted for the sake of clarity. The stand has a foot part 1 on which is situated a receiving part 2 into which the tree that is to be clamped, preferably a Christmas tree, is placed. Arranged circumferentially about an axis of symmetry 3 that largely corresponds to the longitudinal axis of the tree trunk to be clamped are retaining elements 4 that are largely equidistant from one another and that can be pivoted about pivot axes 5 out of an open position into a retaining position. In the open position, the retaining elements are arranged such that the receiving part 2 is largely released. In the retaining position, the retaining elements are pivoted into the receiving part 2, the retaining elements 4 being placed against the tree trunk and exerting a tension force.

The retaining elements 4 are pivoted by means of a flexible connecting part 7, which as a rule is a cable. The cable passes displaceably through bores in the retaining elements. It is also possible for the cable to be conducted through and to act on eyes that are attached to the retaining elements. A single connecting part 7 is present in the exemplary embodiment depicted, and it passes through all of the retaining elements 4 and both of its ends lead into a tensioning device 8. Only a partial length of the cable 7 is illustrated in FIG. 1 for the sake of better clarity. However, it is also possible for a plurality of flexible connecting parts or cables 7 to be present that are actuated together or in groups, whereby two or more retaining elements can be combined to form groups. However, it is also possible for each retaining element to be connected to the tensioning device by means of a separate connecting part.

The tensioning device 8 includes a housing 9 in which a tensioning body in the form of a cable drum 10 is rotatably borne. Both ends of the cable 7, which is in the shape of a closed loop, are attached to or suspended on the cable drum 10 and are wound on this cable drum when the tensioning device is actuated. In order to rotate the cable drum 10, a tension lever 11 is provided that cooperates with the cable drum 10 like a ratchet and rotates the drum in increments in that the tension lever is moved up and down several times. In addition, a foot pedal can be placed at the free end of the tension lever so that the latter can also be easily actuated by foot (not shown here for the sake of better clarity). In the exemplary embodiment depicted, the retaining elements 4 are provided with support bodies 12 in the form of cylindrical rollers. The support bodies 12 are embodied with arched smooth sliding surfaces (not labeled) against which the tree trunk can slide in an alignment position. In the alignment position, the retaining elements are already positioned against the tree trunk with notable force, this force not yet being great enough that the tree is securely clamped. However, the pressing force in this position is already great enough that the tree does not fall over but can still be aligned relatively easily. When aligning the tree, the sliding surfaces of the support bodies slide along the tree trunk. Using this embodiment of the retaining elements with the sliding surfaces, aligning the clamped tree trunk in the stand is possible even with more moderate cable tension. After the tree has been aligned completely, when the tension lever 11 has been actuated again the final retaining force can be attained. The slidability of the sliding surfaces of the support bodies is designed such that in the final clamped condition the retaining force is not limited. Naturally the shape of the support body 12 can also deviate from the illustrated cylinder shape as long as slidability between the tree trunk and the support bodies is assured in the alignment position and sufficient retaining force can be generated in the retaining position so that the tree trunk can be reliably held in the stand. This function is also possible with conventional retaining elements without any type of support body.

Figure 2:
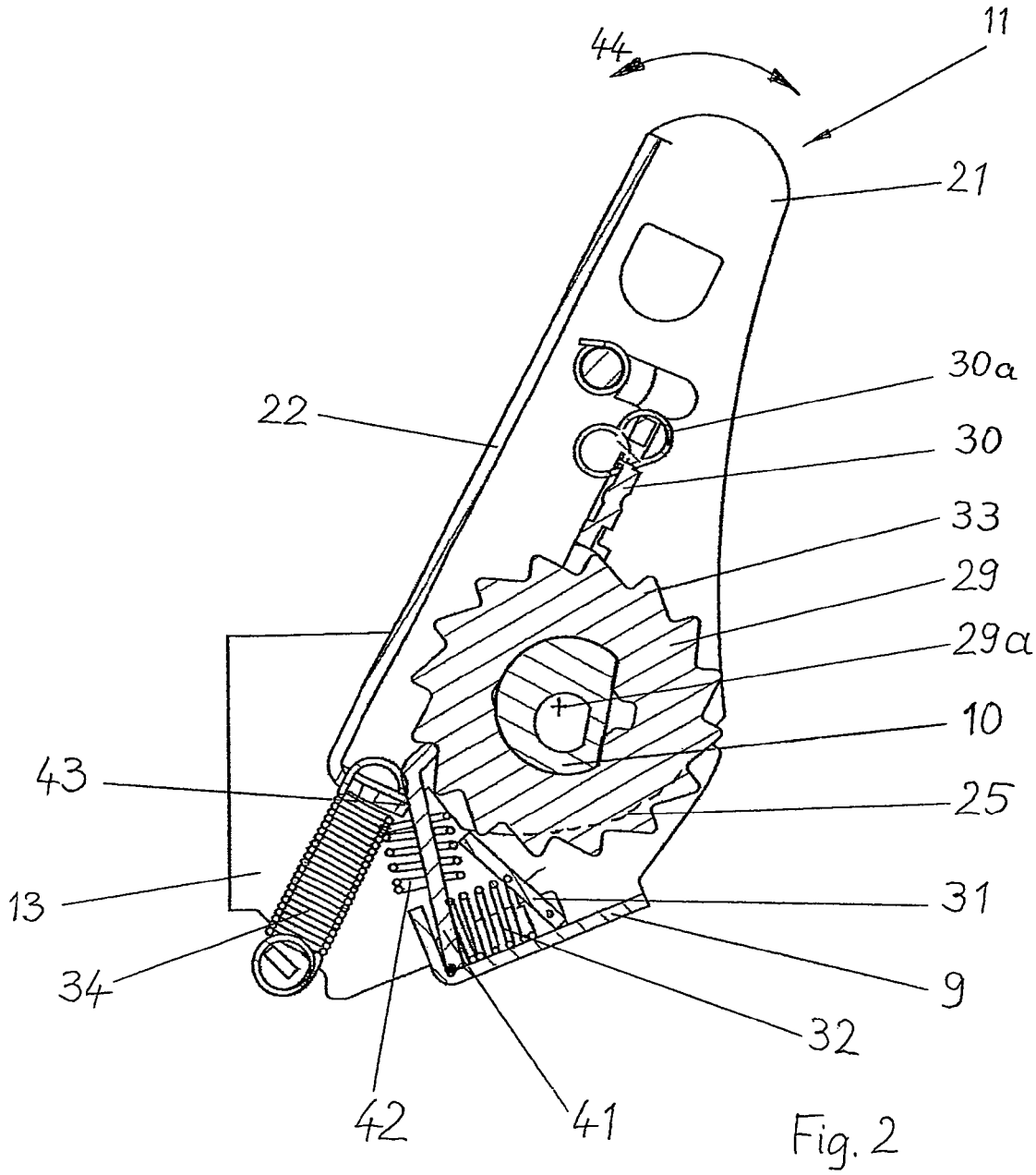
FIG. 2 is a partial sectional view through the tensioning device in accordance with FIG. 1, with the tension lever in the uppermost position.

FIG. 2 is a section of the tensioning device of the inventive tree stand, the sectioning being oriented such that the tension lever 11, which has a lever side section 21, is in cross-section, specifically in its longitudinal direction, so that the cooperation of a first catch 31 and a second catch 41 can be illustrated. The cross-section plane also runs through the housing 9 so that the view is directed at the interior of the side part 13 of the housing 9. The tension lever 11 is rotatably held in the housing 9 in that the cable drum 10 is rotatably movable about its axis of rotation 29*a*, whereby the cable drum 10 is inserted using bearing bores (not labeled) in the housing and bearing bores (also not shown) in the tension lever 11. The tension lever 11 is embodied as U-shaped lever side sections 21, a ratchet wheel 29 being inserted between the side sections of the tension lever 11 and likewise being passed through by the cable drum 10. The cable drum 10 and the ratchet wheel 29 together form a unit that can be rotated as a whole with the common axis of rotation 29*a*, whereby the non-round exterior cross-section of the cable drum 10 is adapted to the cross-section of an aperture located in the ratchet wheel 29. The ratchet 29 is mechanically linked to a lever catch spring 30 and the first catch 31 embodied as a housing catch. The lever catch 30 is pre-stressed by a lever catch spring 30*a* against the teeth 33 of the ratchet wheel 29. In like manner, a spring that is arranged between the first catch 31 and a second catch 41 pre-stresses the first catch 31 against the teeth 33 of the ratchet wheel 29. In an embodiment known per se, the teeth 33 of the ratchet wheel 29 have blocking flanks and inclined flanks so that, in conjunction with the lever catch 30 and the first catch 31, there is the action of a ratchet or one-way coupling.

Furthermore, suspended between the housing 9 of the tensioning device 8 and the tension lever 11 is a tension spring 34 that draws the tension lever 11, after it is depressed out of its upper lever position 44 (depicted by the left side of the double arrow in FIG. 2), upward again, specifically as far as possible.

The lever catch 30 is provided with corresponding control surfaces for engaging in the teeth 33 of the ratchet wheel 29. The principal structure of the lever catch and its function for the tensioning device 8 acting as a ratchet is described in detail in German application DE 10 2005 003 266.4, the disclosure of which is hereby incorporated herein by reference.

The two lever side sections 21 of the tension lever 11 that are joined together by a transverse bar 22 have control curves 25 that cooperate with the first catch 31. When the lever 11 is in the uppermost position 44, the control curve 25 has pressed the first catch 31 against the action of the spring 32 to disengage from the teeth 33 of the ratchet wheel 29, as illustrated in FIG. 2. In this position, if the second catch 41 was not present, the ratchet wheel and thus the cable drum 10 could unwind under the effect of the clamping force of the cable 7 all at once, which would cause the retaining elements immediately to transition out of their retaining position into the release position. However, another control cam 43 is embodied integrally with the lever side section 21, and it cooperates with the second catch 41 against the action of the spring 32. In addition, another spring 42 is provided on the second catch 41. In this uppermost position 44 of the tensioning device 11, the control cam 43 presses against the second catch 41 such that it drops somewhat into a gap between two adjacent teeth and holds, i.e. blocks, the ratchet wheel 29 on a blocking flank of a tooth 33 and thus prevents its free unwinding movement. The tooth spacing thus embodied as a function of tooth shape, number of teeth, and module as well as the shape of the control curve 25 on the lever side sections 21, in cooperation with the control cam 43, define the unwinding path during incremental release of the tensioning device when for instance incremental release of the tensioning device occurs tooth by tooth. The control curve 25 thus cooperates with the first catch 31 such that at the moment at which the first catch has been moved by the control curve 25 out of the teeth of the ratchet wheel 29, the control cam 43 has permitted the second ratchet 41 to move far enough into a gap between adjacent teeth 33 of the ratchet wheel 29 that the further unwinding movement of the ratchet wheel 29 is stopped at the moment at which the second catch 41 strikes the blocking flank of the subsequent tooth 33 of the ratchet wheel 29.

Figure 3:
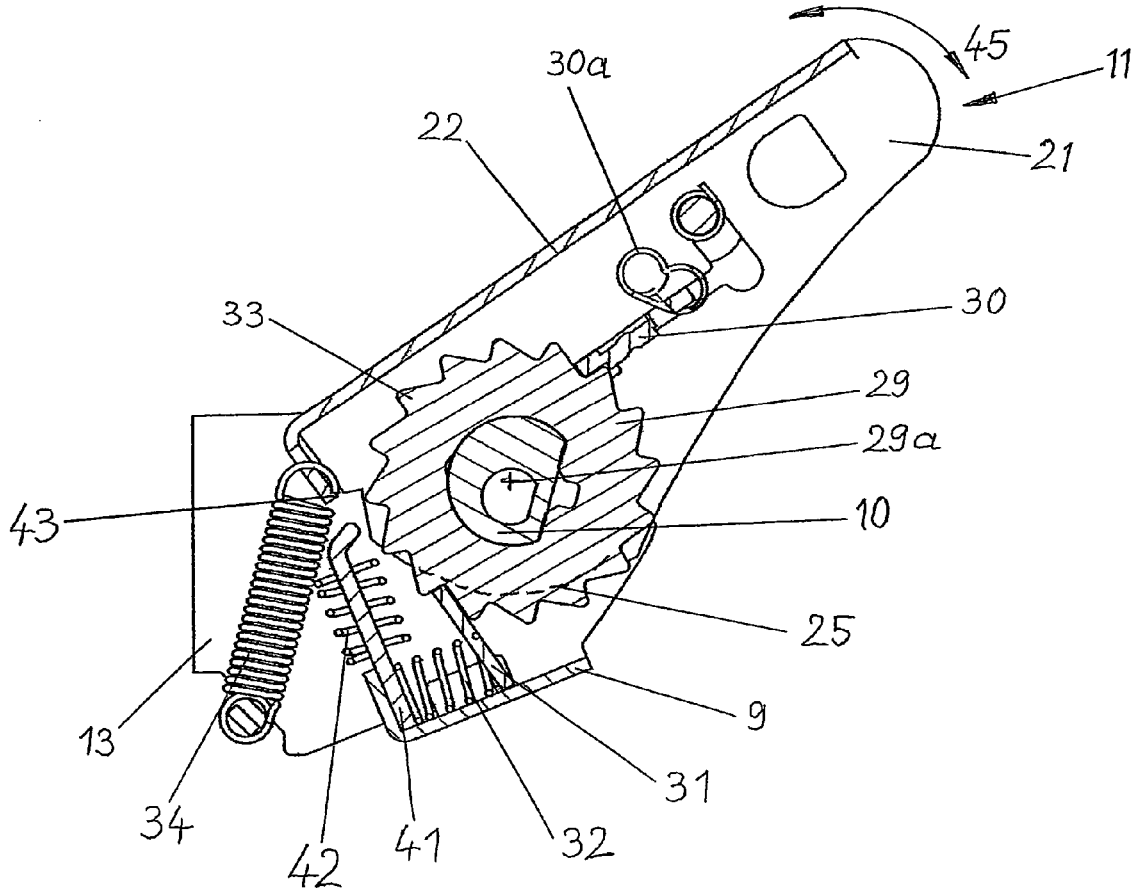
FIG. 3 is a view in accordance with FIG. 1, but with the tension lever in the lowermost position.

FIG. 3 depicts a sectional view of the tensioning device that corresponds to that in FIG. 2, but which is however in the lowermost position 45. In this lowermost position of the tension lever 11, the control curve 25 has eliminated its contact with the first catch 31 so that, given the action of the spring 32, the first catch 31 is pressed into the teeth 33 of the ratchet wheel 29. This pressing of the first catch 31 into a gap between two teeth of the ratchet wheel 29 occurs at a point in time at which the section catch 41, against the action of the spring 42 and the effect of the control cam 43, is still located in a corresponding gap between two adjacent teeth 33 of the ratchet wheel 29. When the first catch 31 moves into a tooth gap and the second catch 42, after release by the control cam 43, has moved completely out of the tooth gap, the ratchet wheel 29 moves until a corresponding blocking flank of the ratchet wheel 29 is blocked by the first catch 31. FIG. 3 illustrates this. If the tension lever 11 of the tensioning device 8 is now moved out of the position 45 in accordance with FIG. 3 back into the position 44 in accordance with FIG. 2, the control curve 25 then presses the first catch 31 out of the teeth of the ratchet wheel 29, and, even before the first catch 31 releases the teeth 33 of the ratchet wheel 29, the control cam 43 presses the second catch 41 back into a gap between two adjacent teeth 33 of the ratchet wheel 29 so that the incremental release in this exemplary embodiment largely encompasses one tooth length. The entire unwinding path thus comprises a first path section that results when the first catch 31 moves out of the blocking flank of the tooth, due to the control curve 25, and a second path section that results after the second catch 42 moved into a tooth gap and finally strikes the blocking flank of the subsequent tooth 33 of the ratchet wheel 29. The entire unwinding path in this example is the equivalent of distance unit between blocking flanks of two adjacent teeth.

Figure 4:
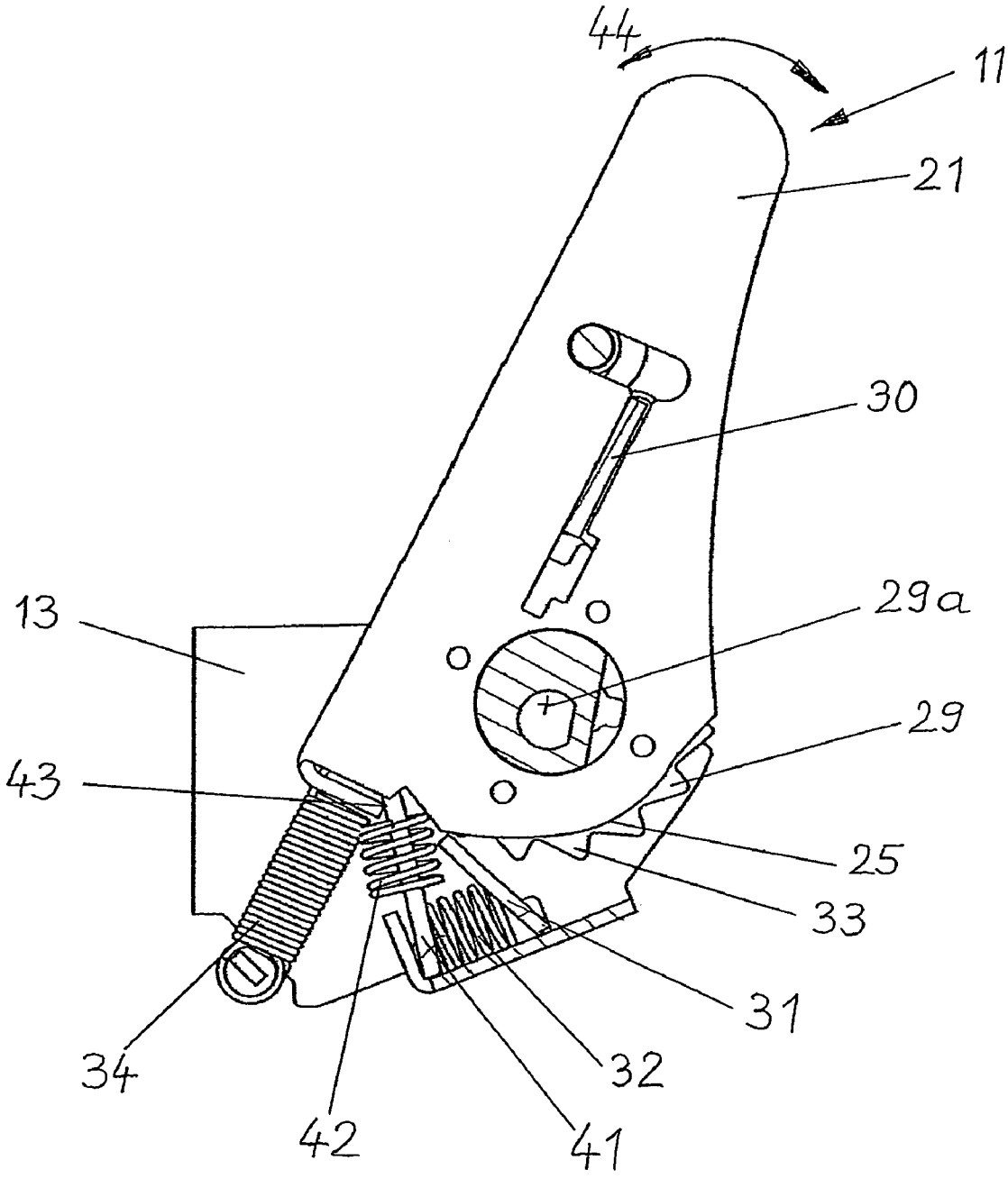
FIG. 4 is a side view of the tensioning device just with the housing cut away in the position in accordance with FIG. 2.

FIG. 4 depicts the uppermost position 44 in accordance with FIG. 2, however the side lever section 21 of the tension lever 11 is not cut away. This makes it possible to better illustrate the control area corresponding to the control curve 25. The control curve 25 has pressed the first catch 31 against the action of the spring 32 out of the teeth of the ratchet wheel 29, the other control cam 43 pressing the second catch 41 against the action of the spring 32 into a tooth gap (not shown for the sake of clarity, but visible in FIG. 2).

Figure 5:
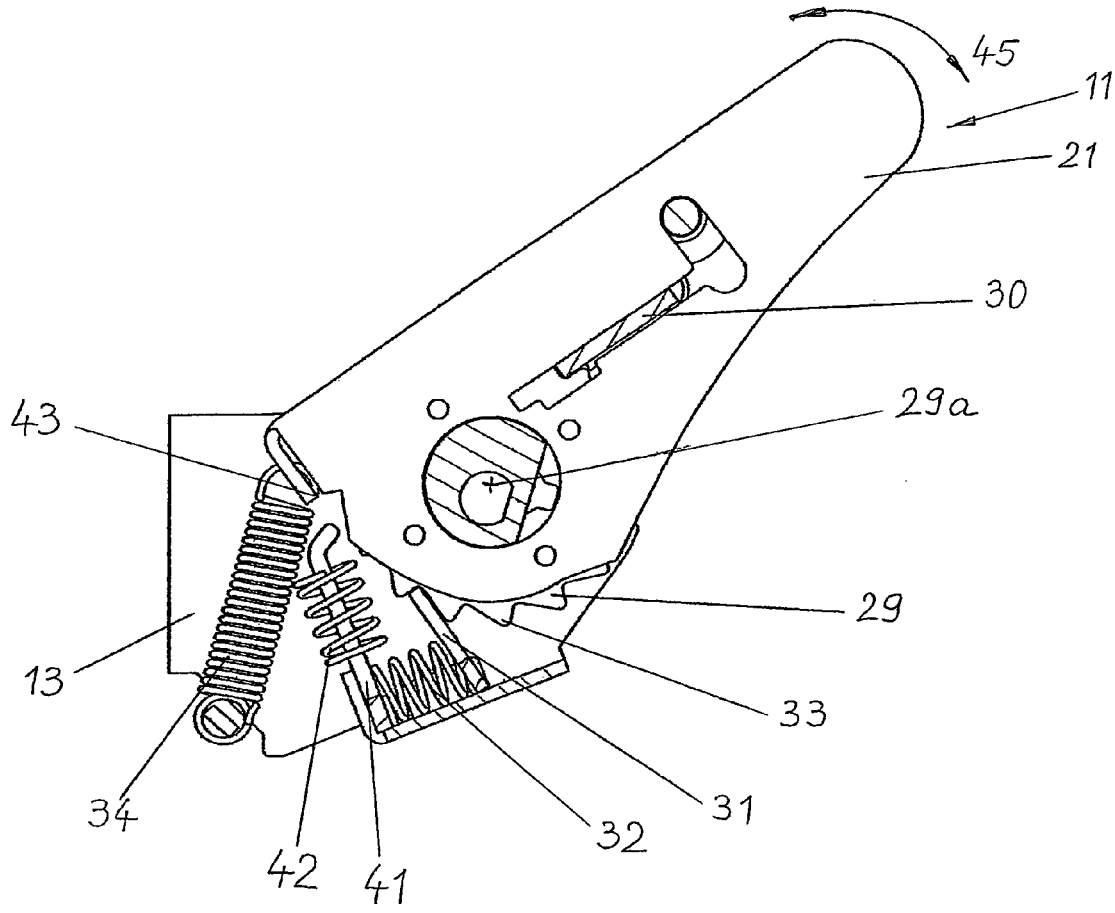
FIG. 5 is a view of the tensioning device in accordance with FIG. 4, however in the position in accordance with FIG. 3.

FIG. 5 corresponds to the depiction in accordance with FIG. 4, but with the tension lever moved into the lowermost position 45. In this position it is possible to see that the first catch engages the teeth of the ratchet wheel 29, whereby the second catch 41 given the action of the spring 32 has disengaged from the teeth 33 of the ratchet wheel 29. The position in accordance with FIG. 4 is attained in that the tension lever 11 is displaced from its position 44 in accordance with FIG. 5 into its position 45 in accordance with FIG. 4. After the release of the tension lever 11, this movement is supported or initiated by the action of the spring 42. When the control cam 43 engages the second catch 41, the latter is pressed into the teeth of the ratchet wheel 29, this blocking the further unwinding path. Thus, for incremental release of the tensioning device and thus of the retaining elements from the trunk of a tree clamped in the stand, an incremental release of the unwinding movement of the tensioning device, i.e., by a defined path, preferably the tooth spacing, is attained using alternating engagement and disengagement of the first catch 31 and of the second catch 41.

Figure 6:
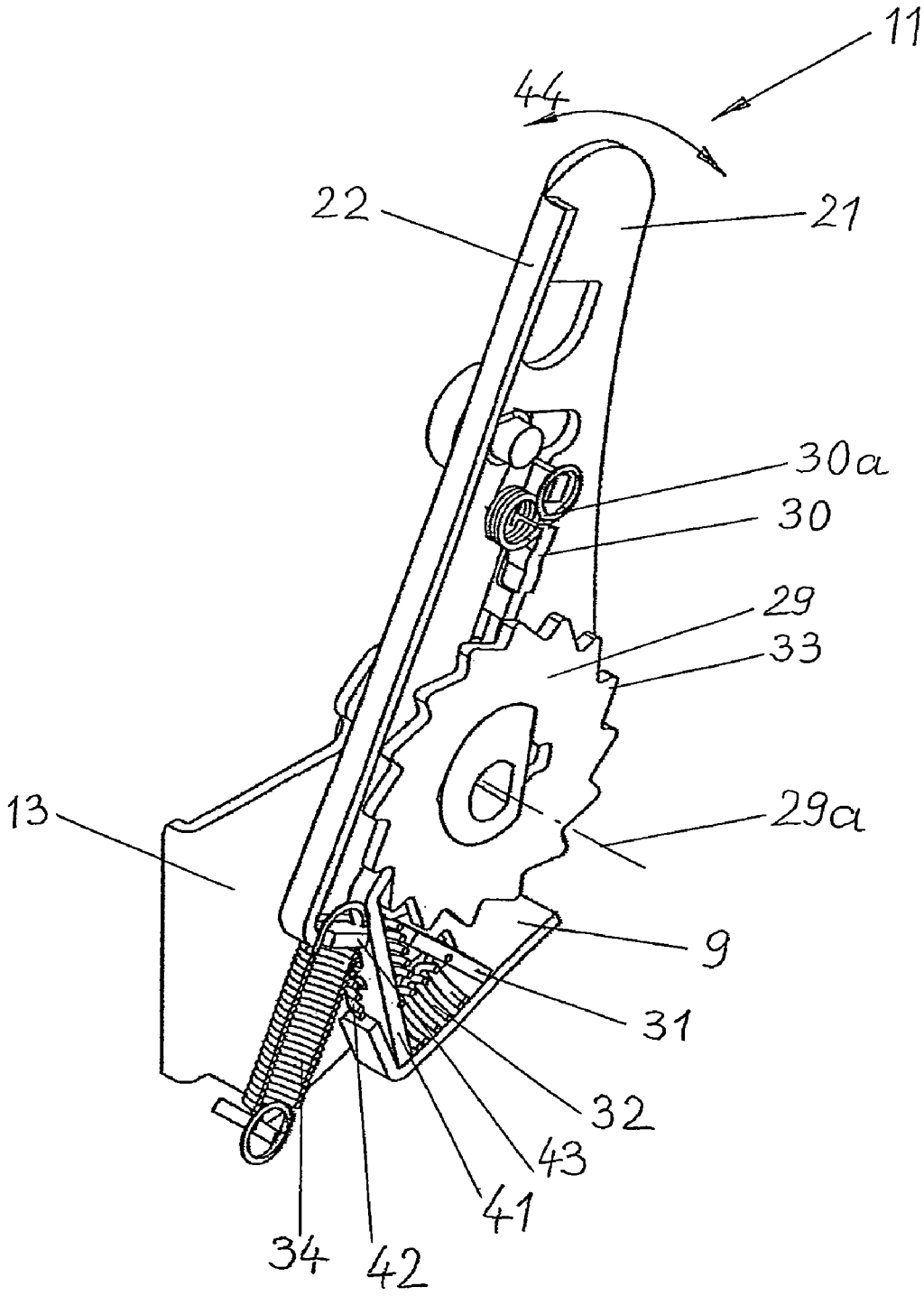
FIG. 6 is a perspective view with sectioned tension lever in a position in accordance with FIG. 2.
Figure 7:
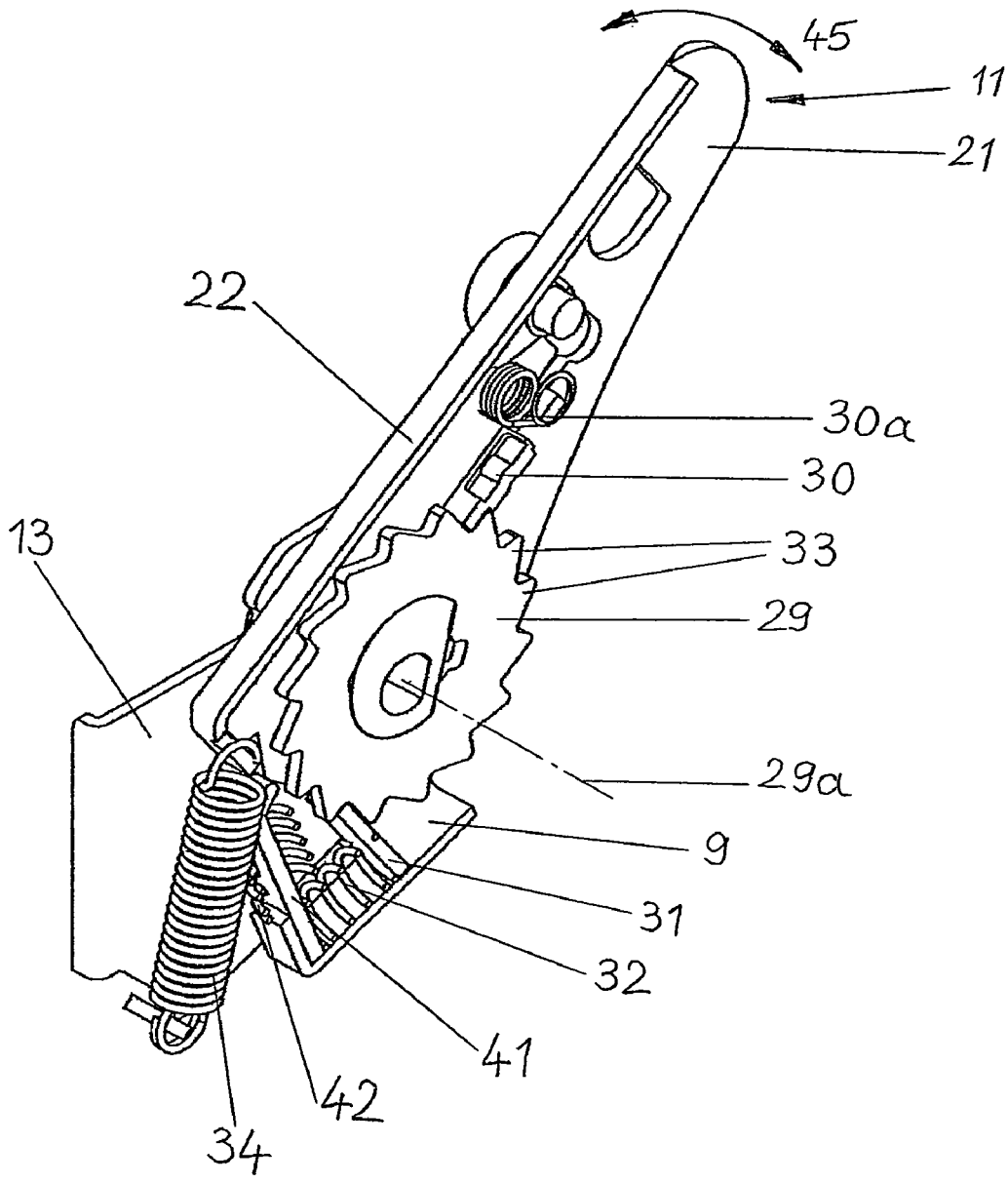
FIG. 7 is a view in accordance with FIG. 6, however in a position in accordance with FIG. 3.

And finally FIGS. 6 and 7 provide perspectives of the two limiting positions, namely the uppermost position 44 and the lowermost position 45, of the tension lever 11, the position in accordance with FIG. 6 corresponding to the manner of working described in FIG. 2 and the position in accordance with FIG. 7 corresponding to the manner of working described in FIG. 3.

Figure 10:
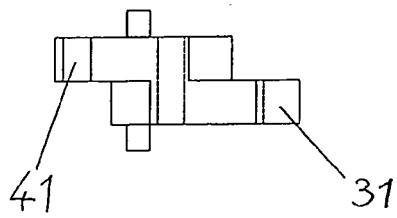
Figure 8:
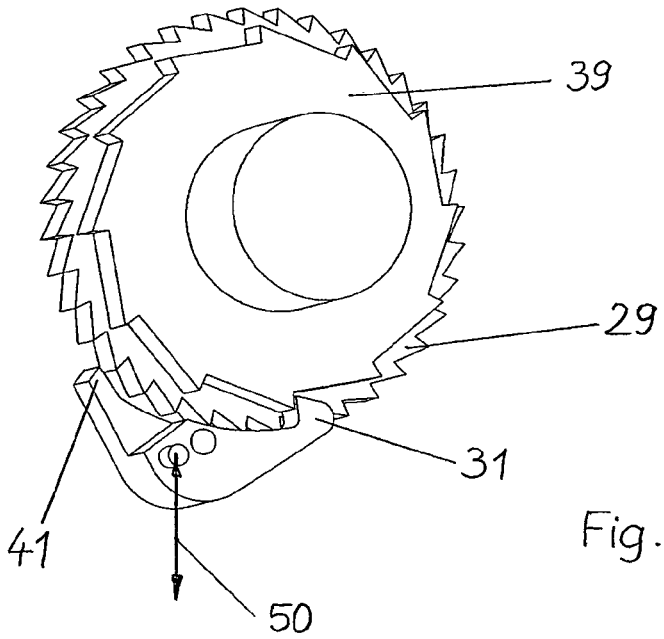
FIG. 8 is an embodiment of a tensioning device of a tree stand with two ratchet wheels and with a first and a second catch that are combined as a rocker, with the second catch engaging the second ratchet wheel.

FIG. 8 depicts a detailed view of an exemplary embodiment in which two ratchet wheels are provided. The first ratchet wheel 29 cooperates with the first catch 31, while the second ratchet wheel 39 cooperates with the second catch 41. Both catches are arranged offset to one another like a crank, as is illustrated in FIG. 10. The first catch 31 and the second catch 41 are embodied like a rocker, their movement for engaging and disengaging being generated by a movement member 50. In the position in accordance with FIG. 8, the first catch 31 is disengaged from the first ratchet wheel 29, while the second catch 41 blocks the unwinding movement.

Figure 9:
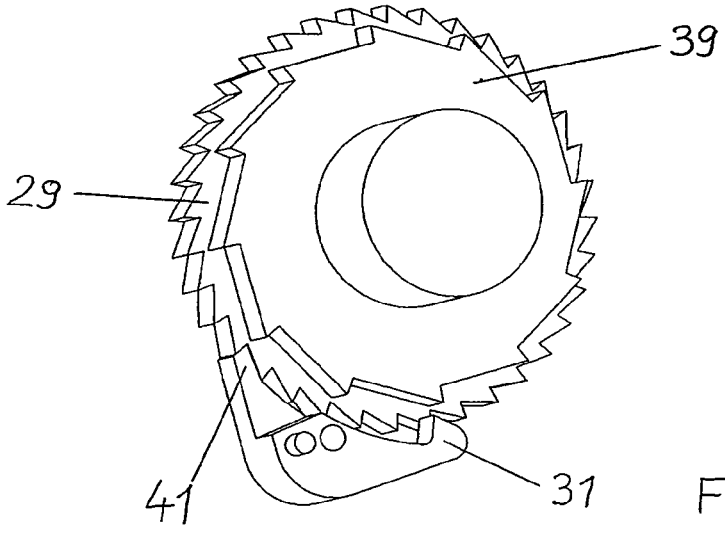
FIG. 9 is an exemplary embodiment in accordance with FIG. 8, but with the first catch engaging the first ratchet wheel; and, FIG. 10 is a principle drawing of a side view of the arrangement of the first catch and the second catch relative to one another.

FIG. 9 also illustrates a partial view of the exemplary embodiment in accordance with FIG. 8. In the position illustrated, however, the first catch 31 engages the teeth of the first ratchet wheel 29 and blocks its unwinding movement, while the second catch 41 is situated between two adjacent teeth of the ratchet wheel 39 disengaged from the teeth and the blocking flank of the tooth. With regard to their movement, the two catches are coupled to one another such that when the associated ratchet wheel 29 or 39 is released by the one of the two catches 31, 42, the other of the two catches has already moved into a gap between adjacent teeth of the associated ratchet wheel.

| Legends | |
|---|---|
| 1 | Foot part |
| 2 | Receiving part |
| 3 | Axis of symmetry |
| 4 | Retaining element |
| 5 | Pivot axis of retaining element |
| 6 | Bore |
| 7 | Flexible connecting part, cable |
| 8 | Tensioning device |
| 9 | Housing |
| 10 | Tensioning body, cable drum |
| 11 | Tension lever |
| 12 | Support body |
| 13 | Side part |
| 21 | Lever side section |
| 22 | Transverse bar |
| 25 | Control curve |
| 29 | Ratchet wheel or first ratchet wheel |
| 29a | Axis of rotation |
| 30 | Lever catch |
| 30a | Lever catch spring |
| 31 | First catch |
| 32 | Spring between first and second catch |
| 33 | Teeth of ratchet wheel |
| 34 | Tension spring |
| 39 | Second ratchet wheel |
| 41 | Second catch (incremental blocking catch) |
| 42 | Spring for second catch |
| 43 | Control cam |

-continued

| Legends | |
|---|---|
| 44 | Upper lever position |
| 45 | Lower lever position |
| 50 | Movement member for rocker |

The invention claimed is:

1. Tree stand, comprising a foot part, at least two retaining elements arranged about an axis of symmetry of the foot part, the retaining elements each being movable between a release position, in which a tree is adjustable in said tree stand or can be removed therefrom, and a retaining position in which a tree is held in said tree stand, in a plane intersecting the axis of symmetry, at least one flexible connecting part that can be loaded with tension, a tensioning device comprising a rotatable tension lever, a ratchet wheel, a tensioning body arranged coaxially with the ratchet wheel, and a lever catch that is movably guided on said tension lever to act as a ratchet or one-way coupling and that is detachably mechanically linked to said ratchet wheel, whereby said connecting part is wound on said tensioning body, thus securely clamping said tree, the tensioning device further comprising a first catch which enters a gap between two adjacent teeth of said ratchet wheel and blocks rotation of the ratchet wheel in a direction of unwinding the connecting part, and which, for each release actuation of said tension lever counter to the direction of its movement of said tension lever during tensioning actuation, disengages from said teeth of said ratchet wheel, thus resulting in a release movement of said tensioning body by an unwinding path that is shorter than a maximum unwinding path of said tensioning body, and the tensioning device further comprising a second catch which enters a gap between two adjacent teeth of said ratchet wheel, thereby to block further release after said second catch strikes one of said two adjacent teeth defining an extreme of said gap in the release direction.

2. Tree stand, with a foot part, at least two retaining elements that are arranged movably about an axis of symmetry of the foot part, the retaining elements being movable between a release position, in which a tree is adjustable in said tree stand or can be removed therefrom, and a retaining position, in which a tree is held in said tree stand, in a plane intersecting the axis of symmetry, at least one flexible connecting part that can be loaded with tension, a tensioning device comprising a rotatable tension lever, a first ratchet wheel, a tensioning body arranged coaxially with the first ratchet wheel, and a lever catch that is movably guided on said tension lever to act as a ratchet or one-way coupling and that is detachably mechanically linked to said first ratchet wheel and that when said tension lever is actuated to create tension, engages the teeth of said first ratchet wheel whereby said connecting part is wound on said tensioning body, thus securely clamping said tree, the tensioning device further comprising a first catch which engages the teeth of said first ratchet wheel and blocks rotation of the first ratchet wheel in a direction of unwinding the connecting part, a second ratchet wheel and a second catch, whereby, for each release actuation of said tension lever counter to its movement during tensioning actuation, said first catch disengages from said teeth of said first ratchet wheel, resulting in a release movement of said tensioning body by an unwinding path that is shorter than the maximum unwinding path of said tensioning body and then the second catch blocks further release after said second catch strikes a back tooth, in the unwinding direction, of said second ratchet wheel.

3. Tree stand in accordance with claim 2, wherein said second ratchet wheel is coaxial with said first ratchet wheel and has the same phase and rotates therewith.

4. Tree stand in accordance with claim 2 or 3, wherein said first ratchet wheel and said second ratchet wheel have a same tooth module.

5. Tree stand in accordance with any of claims 2 or 3, wherein said first ratchet wheel and said second ratchet wheel have tooth modules that are different from one another.

6. Tree stand in accordance with any of claims 1 through 3, wherein said first catch and said second catch alternately block and release tooth by tooth the respective first and second ratchet wheels with which said first and second catches are associated.

7. Tree stand in accordance with claim 6, wherein said first and second catches are coupled to one another whereby when said respective first or second ratchet wheel is released by the respective first or second catch, the other of said first and second catches has already moved into a gap between adjacent teeth of the other of said first and second ratchet wheels.

8. Tree stand in accordance with any of claims 1 through 3, wherein said first catch is so mounted as to enter into blocking engagement with the ratchet wheel with which the first catch is associated by gravitational force or wherein the tree stand further comprises a spring which effects said blocking engagement by force of said spring.

9. Tree stand in accordance with any of claims 1 through 3, further comprising a control means integral with said tension lever and having a curved surface for engaging said first catch thereby to cause said first catch to disengage from said teeth of said ratchet wheel, and, when said tension lever approaches an upper position, to disengage said first catch from said teeth of said associated ratchet wheel.

10. Tree stand in accordance with any of claims 1 through 3, wherein said tensioning device further comprises a housing and a spring arranged between said first and second catches, said spring actuating said first catch to engage said teeth of said ratchet wheel associated with said first catch.

11. Tree stand in accordance with any of claims 1 through 3, wherein said retaining elements comprise ached, smooth sliding surfaces or support bodies adapted to slide on the trunk of said ratchet wheel.

12. Tree stand in accordance with any of claims 1 through 3, further comprising key or switching means for suppressing function of said decond catch of effecting incremental transition of said retaining elements from the retaining position thereof to the release position thereof, thereby to facilitate removing of a tree from said tree stand.

13. Tree stand in accordance with claim 12, further comprising an aperture in said tension lever for receiving the key, the aperture being so located that the key, when inserted in the aperture, holds said second catch against the action of said spring thereby to disengage said second catch from said teeth of said ratchet wheel with which said catch is associated.

14. Tree stand in accordance with any of claims 1 through 3, further comprising a control cam so arranged as to move said second catch into the gap between adjacent teeth of the ratchet wheel with which the second catch is associated.

15. Tree stand in accordance with claim 14, wherein said control cam is integral with said tension lever.

16. Tree stand in accordance with any of claims 1 through 3, wherein said first and said second catch are pivoted for rocking about a common axis of rotation into and out of engagement with said teeth of the ratchet wheel with which the respective said catch is associated.

17. Tree stand in accordance with claim 16, wherein said first and said second catch are rigidly joined to one another and, depending on the diameter and tooth module of the ratchet wheel with which the respective said catch is associated, form an angle such that, when said first catch is in a disengaged position, said second catch moves into a gap between adjacent teeth of the ratchet wheel with which said second catch is associated, and blocks rotation thereof in a direction of unwinding of the connecting part.

18. Tree stand, comprising a foot part, at least two retaining elements arranged about an axis of symmetry of the foot part, the retaining elements each being movable between a release position, in which a tree is adjustable in said tree stand or can be removed therefrom, and a retaining position, in which a tree is held in said tree stand, in a plane intersecting the axis of symmetry, comprising at least one flexible connecting part that can be loaded with tension, a tensioning device comprising a rotatable tension lever, a ratchet wheel, a tensioning body arranged coaxially with the ratchet wheel, and a lever catch that is movably guided on said tension lever to act as a ratchet or one-way coupling and that is detachably mechanically linked to said ratchet wheel and that, when said tension lever is actuated to create tension, engages teeth of said ratchet wheel whereby said connecting part is wound on said tensioning body, thus securely clamping said tree, the tensioning device further comprising a first catch which engages the teeth of said ratchet wheel and blocks rotation of the ratchet wheel in a direction of unwinding the connecting part, and which, for each release actuation of said tension lever counter to direction of movement of said tension lever during tensioning actuation, disengages from said teeth of said ratchet wheel, this resulting in a release movement of said tensioning body by an unwinding path that is shorter than a maximum unwinding path, and the first catch then again moves into a gap between adjacent teeth of said ratchet wheel and blocks further release after said catch strikes the back tooth, in the unwinding direction, of said gap.

* * * * *